US006954122B2

(12) United States Patent
Wilber et al.

(10) Patent No.: US 6,954,122 B2
(45) Date of Patent: Oct. 11, 2005

(54) HYBRID TRIPLE-MODE CERAMIC/METALLIC COAXIAL FILTER ASSEMBLY

(75) Inventors: William Wilber, Southbury, CT (US); Weili Wang, Rocky Hill, CT (US)

(73) Assignee: Radio Frequency Systems, Inc., Meriden, CT (US)

( * ) Notice: Subject to any disclaimer, the term of this patent is extended or adjusted under 35 U.S.C. 154(b) by 0 days.

(21) Appl. No.: 10/735,777

(22) Filed: Dec. 16, 2003

(65) Prior Publication Data

US 2005/0128031 A1 Jun. 16, 2005

(51) Int. Cl.[7] ..... H01P 1/20; H01P 7/10
(52) U.S. Cl. ..... 333/202; 333/206
(58) Field of Search ..... 333/202, 208, 333/212, 219.1, 206, 219

(56) References Cited

U.S. PATENT DOCUMENTS

| | | | | | |
|---|---|---|---|---|---|
| 4,431,977 | A | | 2/1984 | Sokola et al. | |
| 4,614,920 | A | | 9/1986 | Tong | |
| 5,083,102 | A | | 1/1992 | Zaki | |
| 5,325,077 | A | | 6/1994 | Ishikawa et al. | |
| 5,589,807 | A | | 12/1996 | Tang | |
| 5,783,979 | A | * | 7/1998 | Andoh et al. | 333/202 |
| 5,821,837 | A | | 10/1998 | Accatino et al. | |
| 5,859,574 | A | | 1/1999 | Schmitt | |
| 6,081,175 | A | * | 6/2000 | Duong et al. | 333/212 |
| 6,359,534 | B2 | | 3/2002 | Hunter | |
| 6,484,043 | B1 | | 11/2002 | Klein et al. | |
| 6,507,254 | B1 | | 1/2003 | Hattori et al. | |
| 6,535,086 | B1 | | 3/2003 | Liang et al. | |
| 6,552,628 | B2 | | 4/2003 | Jang | |
| 6,556,106 | B1 | * | 4/2003 | Sano et al. | 333/202 |
| 6,563,397 | B1 | | 5/2003 | Jang | |
| 2002/0003461 | A1 | | 1/2002 | Hunter | |
| 2002/0041221 | A1 | | 4/2002 | Abdulnour | |
| 2002/0093395 | A1 | | 7/2002 | Jang | |
| 2002/0186103 | A1 | * | 12/2002 | Ando et al. | 333/202 |
| 2003/0090342 | A1 | | 5/2003 | Wilber et al. | |
| 2003/0090343 | A1 | | 5/2003 | Wilber et al. | |
| 2003/0090344 | A1 | | 5/2003 | Wang et al. | |
| 2003/0117244 | A1 | * | 6/2003 | Matsuura et al. | 333/219 |

FOREIGN PATENT DOCUMENTS

| | | | | |
|---|---|---|---|---|
| EP | 1122807 | A1 * | 8/2001 | H01P/1/20 |
| EP | 1265313 | A2 | 12/2002 | |
| EP | 1313164 | A2 | 5/2003 | |

OTHER PUBLICATIONS

Tikhov et al., "A Novel Surface Mount Filter Based on a Triple–Mode Ceramic Cavity", Radio and Wireless Conference, 2001. RAWCON 2001. IEEE , Aug. 19–22, 2001, pp. 161–164.*

Sethares, J. C. and S.J. Naumann, Design of Microwave Dielectric Resonators, IEEE Trans. Microwave Theory Tech., vol. 14, Issue 1, pp. 2–7, Jan. 1966.

Lastoria, G., G. Gerini, M. Guglielmi and F. Emma, "CAD of Triple–Mode Cavities in Rectangular Waveguide", IEEE Trans. Microwave Theory Tech., vol. 8, Issue 10, pp. 339–341, Oct. 1998.

Sano, K., and M. Miyashita, "Application of the Planar I/O Terminal to Dual–Mode Dielectric–Waveguide Filter", IEEE Trans. Microwave Theory Tech., vol. 48, No. 12 pp. 2491–2495, Dec. 2000.

* cited by examiner

*Primary Examiner*—Seungsook Ham
(74) *Attorney, Agent, or Firm*—Sughrue Mion, PLLC; Tom C. Gellenthien; V. Lawrence Sewell

(57) ABSTRACT

A hybrid filter assembly is provided having a first ceramic triple-mode mono-block resonator, a second ceramic triple-mode mono-block resonator and at least one metallic resonator coupled to at least one of the first and second mono-block resonators. Each triple-mode mono-block resonator supports three resonant modes and each metallic resonator supports an additional mode, thereby providing a hybrid filter assembly of reduced size having more than six poles.

12 Claims, 23 Drawing Sheets

HYBRID TRIPLE-MODE CERAMIC/METALLIC COAXIAL FILTER ASSEMBLY

BACKGROUND OF THE INVENTION

1. Field of the Invention

The present invention relates to filter assemblies. More particularly, the present invention relates to hybrid triple-mode ceramic/metallic microwave filters that are smaller and less costly than comparable metallic combline resonators.

2. Background of the Invention

When generating signals in communication systems, combline filters are used to reject unwanted signals. Current combline filter structures consist of a series of metallic resonators dispersed in a metallic housing. Because of the required volume for each resonator, the metallic housing cannot be reduced in size beyond current technology, typically 3–10 cubic inches/resonator, depending on the operating frequency and the maximum insertion loss. Furthermore, the metallic housing represents a major cost percentage of the entire filter assembly. Consequently, current metallic filters are too large and too costly.

SUMMARY OF THE INVENTION

In an illustrative embodiment of the present invention, a hybrid filter assembly is provided having a first ceramic triple-mode mono-block resonator, a second ceramic triple-mode mono-block resonator and a metallic coaxial resonator coupled to at least one of the first and second mono-block resonators. Each triple-mode mono-block resonator supports three resonant modes and the metallic coaxial resonator supports an additional mode, thereby providing a hybrid filter assembly having seven poles.

In another illustrative embodiment of the present invention, a hybrid filter assembly is provided having a first ceramic triple-mode mono-block resonator, a second ceramic triple-mode mono-block resonator and a pair of metallic coaxial resonators coupled to at least one of the first and second mono-block resonators. Each triple-mode mono-block resonator supports three resonant modes and each metallic coaxial resonator supports an additional mode, thereby providing a hybrid filter assembly having eight poles.

In another illustrative embodiment of the present invention, a method is shown for increasing the number of poles for a resonator filter by coupling at least one metallic coaxial resonator to at least one of a first triple-mode mono-block resonator and a second triple-mode mono-block resonator.

BRIEF DESCRIPTION OF THE DRAWINGS

FIG. 1*b* is a view showing a probe inserted into the mono-block.

FIG. 21(*b*) is a wire-frame view of the hybrid filter assembly shown in FIG. 21.

FIG. 22(*b*) is a bottom view of the hybrid filter assembly shown in FIG. 22(*a*).

FIG. 24(*b*) is a bottom view of the hybrid filter assembly shown in FIG. 24(*a*).

DETAILED DESCRIPTION OF THE INVENTION

It is desirable to reduce the size and cost of the filter assemblies beyond what is currently possible with metallic combline structures which are presently used to attenuate undesired signals. The present invention incorporates triple-mode resonators into an assembly that includes a mask filter and a low pass filter such that the entire assembly provides the extended frequency range attenuation of the unwanted signal. The assembly is integrated in a way that minimizes the required volume and affords easy mounting onto a circuit board.

Triple-Mode Mono-Block Cavity

Filters employing triple-mode mono-block cavities afford the opportunity of significantly reducing the overall volume of the filter package and reducing cost, while maintaining acceptable electrical performance. The size reduction has two sources. First, a triple-mode mono-block resonator has three resonators in one block. (Each resonator provides one pole to the filter response). This provides a 3-fold reduction in size compared to filters currently used which disclose one resonator per block. Secondly, the resonators are not air-filled coaxial resonators as in the standard combline construction, but are now dielectric-filled blocks. In a preferred embodiment, they are a solid block of ceramic coated with a conductive metal layer, typically silver. The high dielectric constant material allows the resonator to shrink in size by approximately the square root of the dielectric constant, while maintaining the same operating frequency. In a preferred embodiment, the ceramic used has a dielectric constant between 35 and 36 and a Q of 2,000. In another embodiment, the dielectric constant is 44 with a Q of 1,500. Although the Q is lower, the resonator is smaller due to the higher dielectric constant. In still another preferred embodiment, the dielectric constant is 21 with a Q of 3,000.

Furthermore, because the mono-block cavities are self-contained resonators, no metallic housing is required. The cost reduction from eliminating the metallic housing is greater than the additional cost of using dielectric-filled resonators as opposed to air-filled resonators.

The concept of a mono-block is not new. However, this is the first triple-mode mono-block resonator. In addition, the ability to package the plated mono-block triple-mode resonator filled with low loss, high dielectric constant material into a practical filter and assembly is novel and unobvious.

Figure 1A:
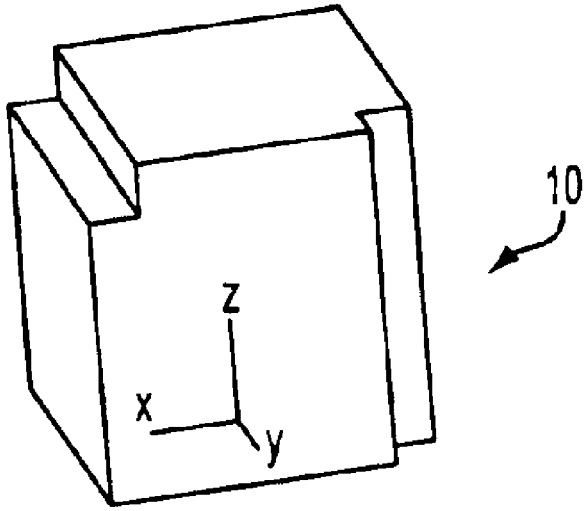
FIGS. 1*a* and 1*b* are two views of the fundamental triple-mode mono-block shape.
Figure 1B:
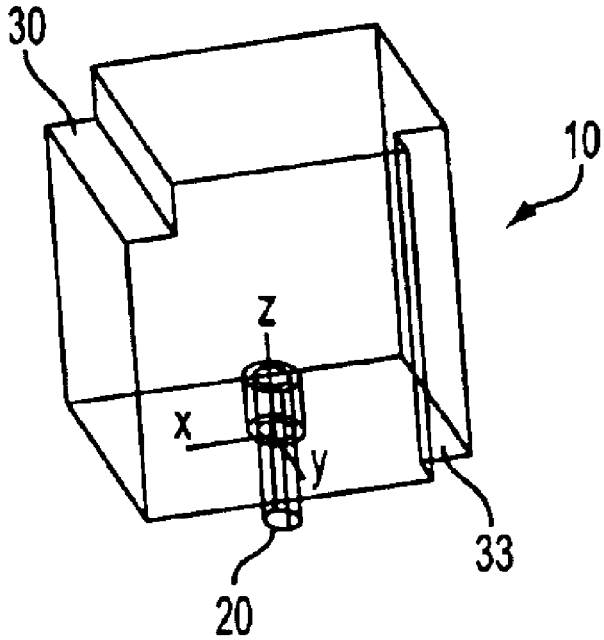

The basic design for a triple-mode mono-block resonator 10 is shown in FIG. 1 in which two views 1(*a*) and 1(*b*) are shown of the fundamental triple-mode mono-block shape. It is an approximately cubic block. The three modes that are excited are the TE110, TE101 and TE011 modes. See J. C. Sethares and S. J. Naumann. "Design of Microwave Dielectric Resonators," IEEE Trans. Microwave Theory Tech., pp. 2–7, January 1966, hereby incorporated by reference. The three modes are mutually orthogonal. The design is an improvement to the triple-mode design for a rectangular (hollow) waveguide described in G. Lastoria, G. Gerini, M. Guglielmi and F. Emma, "CAD of Triple-Mode Cavities in Rectangular Waveguide," IEEE Trans. Microwave Theory Tech., pp. 339–341, October 1998, hereby incorporated by reference.

The three resonant modes in a triple-mode mono-block resonator are typically denoted as TE011, TE101, and TE110 (or sometimes as TEδ11, TE1δ1, and TE11δ), where TE indicates a transverse electric mode, and the three successive indices (often written as subscripts) indicate the number of half-wavelengths along the x, y and z directions. For example, TE101 indicates that the resonant mode will have an electric field that varies in phase by 180 degrees (one-half wavelength) along the x and z directions, and there is no variation along the y direction. For this discussion, we will refer to the TE110 mode as Mode 1, TE101 as Mode 2, and TE011 as mode 3.

Corner Cuts

The input and output power is coupled to and from the mono-block 10 by a probe 20 inserted into an input/output port 21 in the mono-block 10 as seen in FIG. 1(*b*). The probe can be part of an external coaxial line, or can be connected to some other external circuit. The coupling between modes is accomplished by corner cuts 30, 33. One is oriented along the Y axis 30 and one is oriented along the Z axis 33. The two corner cuts are used to couple modes 1 and 2 and modes 2 and 3. In addition to the corner cuts shown in FIG. 1, a third corner cut along the X axis can be used to cross-couple modes 1 and 3.

Figure 2:
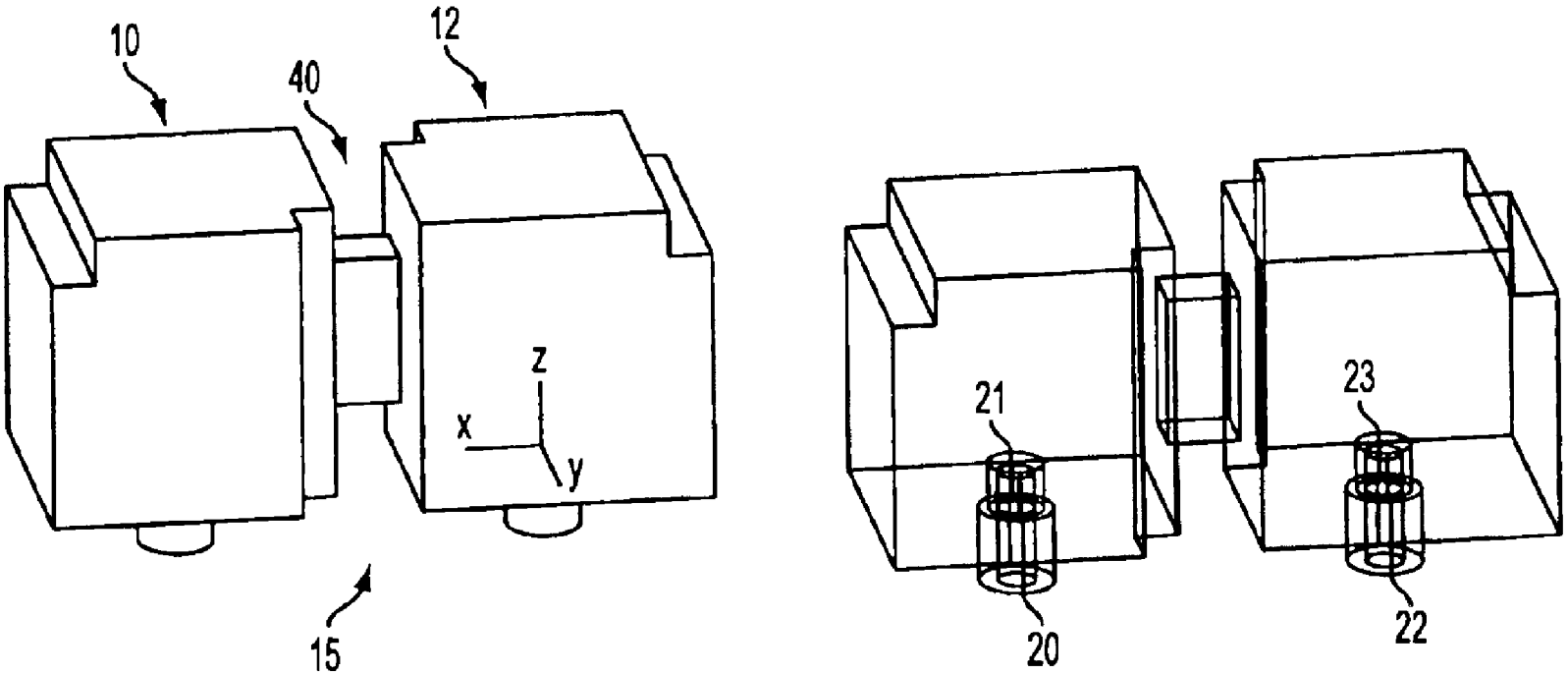
FIG. 2 is a solid and wire-frame view of two mono-blocks connected together to form a 6-pole filter.

FIG. 2 is a solid and a wire-frame view showing two of the triple-mode mono-blocks connected together 10, 12 to form a six-pole filter 15 (each triple-mode mono-block resonator has 3 poles). A connecting aperture or waveguide 40 links windows in each of the blocks together. The aperture can be air or a dielectric material. The input/output ports 21, 23 on this filter are shown as coaxial lines connected to the probes 20, 22 (see FIG. 1) in each block 10, 12.

Corner cuts 30, 33 are used to couple a mode oriented in one direction to a mode oriented in a second mutually orthogonal direction. Each mode represents one pole in the filter's response. Therefore, the triple-mode mono-block discussed above represents the equivalent of three poles or three electrical resonators.

Figure 3A:
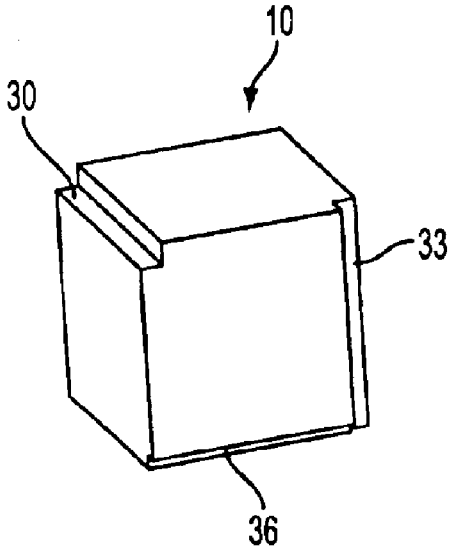
FIGS. 3*a* and 3*b* are solid and wire-frame views of the mono-block with a third corner cut.
Figure 3B:
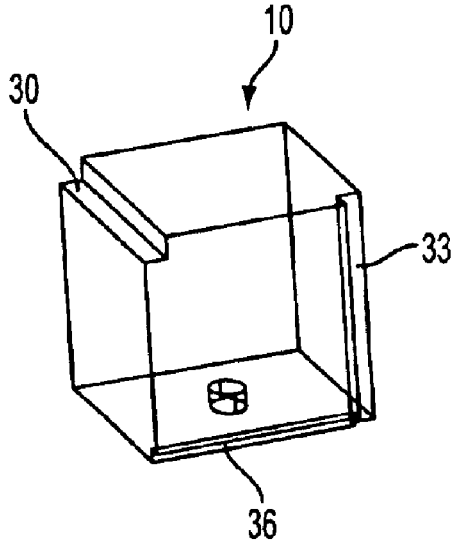

FIG. 3 shows a third corner cut 36 (on the bottom for this example) that provides a cross coupling between modes 1 and 3 in the mono-block. A solid block is shown in part 3(*a*) and a wire frame view is shown in 3(*b*). By the appropriate choice of the particular block edge for this corner cut, either positive or negative cross coupling is possible.

Tuning

Tuning: Like most other high precision, radio frequency filters, the filter disclosed here is tuned to optimize the filter response. Mechanical tolerances and uncertainty in the dielectric constant necessitate the tuning. The ability to tune, or adjust, the resonant frequencies of the triple-mode mono-block resonator 10 enhances the manufacturability of a filter assembly that employs triple-mode mono-blocks as resonant elements. Ideally, one should be able to tune each of the three resonant modes in the mono-block independently of each other. In addition, one should be able to tune a mode's resonant frequency either higher or lower.

Four novel and unobvious methods of tuning are disclosed. The first tuning method is to mechanically grind areas on three orthogonal faces of the mono-block 10 in order to change the resonant frequencies of the three modes in each block. By grinding the areas, part of the silver plating and dielectric material is removed, thereby changing the resonant frequencies of the resonant modes.

This method is mechanically simple, but is complicated by the fact that the grinding of one face of the mono-block 10 will affect the resonant frequencies of all three modes. A computer-aided analysis is required for the production environment, whereby the effect of grinding a given amount of material away from a given face is known and controlled.

Figure 4:
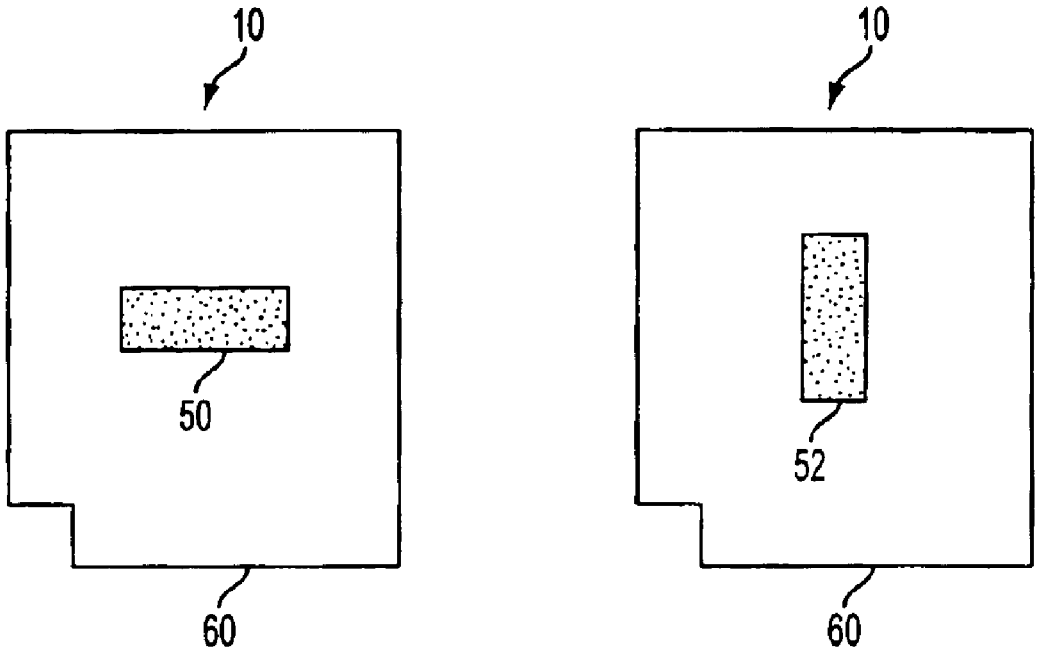
FIG. 4 illustrates a slot cut within a face of the resonator.
Figure 5:
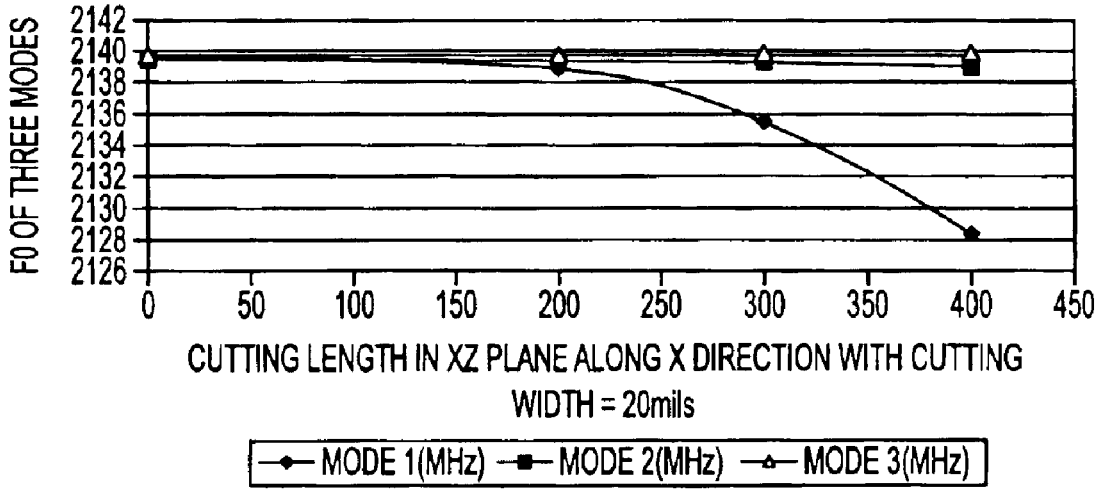
FIG. 5 is a graph of resonant frequencies of Modes 1, 2 and 3 vs. cutting length for a slot cut along the X-direction on the X-Z face.
Figure 6:
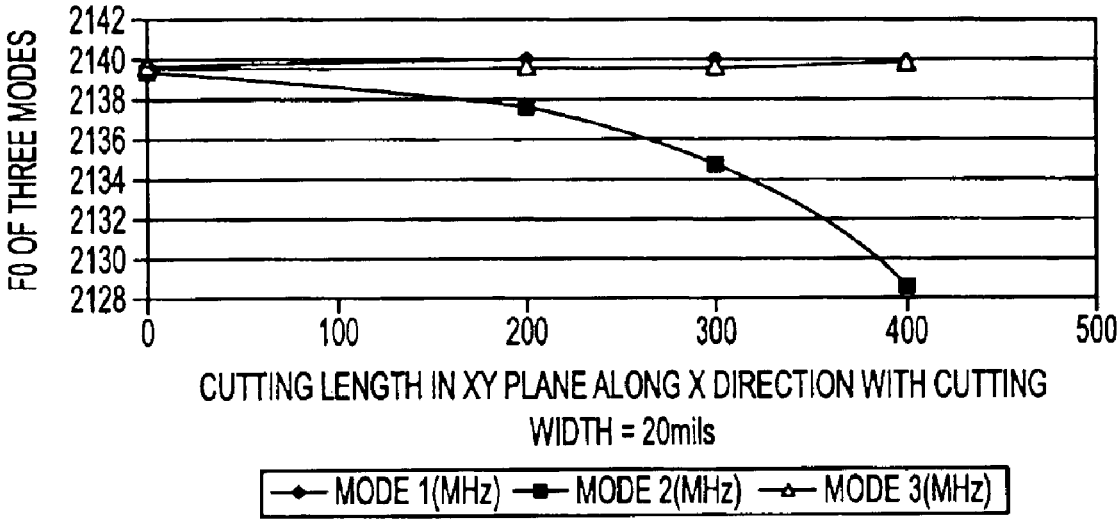
FIG. 6 is a graph of resonant frequencies of Modes 1. 2 and 3 vs. cutting length for a slot cut along the X-direction on the X-Y face.
Figure 7:
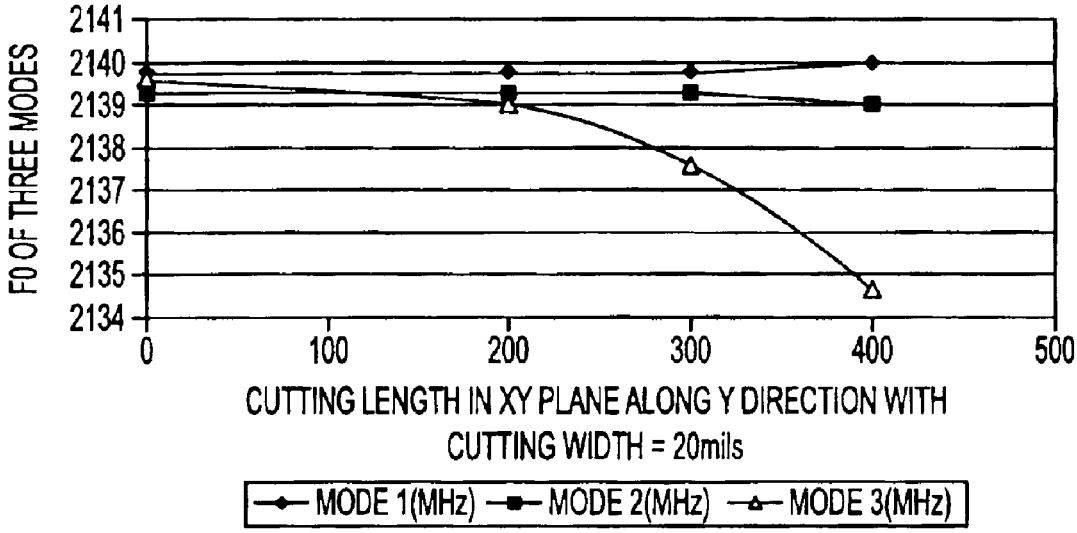
FIG. 7 is a graph of resonant frequencies of Modes 1, 2 and 3 vs. cutting length for a slot cut along the Y-direction on the X-Y face.
Figure 8A:
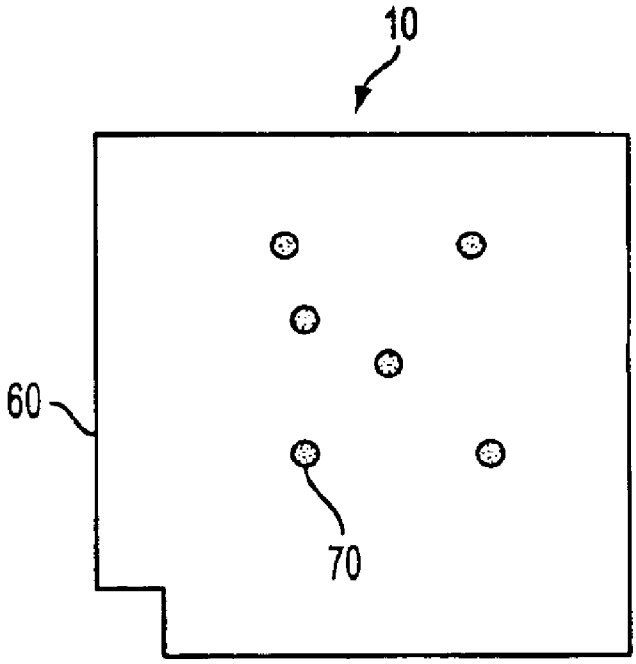
FIG. 8*a* illustrates a method of tuning the mono-block by removing small circular areas of the conductive surface from a particular face of the mono-block.
Figure 8B:
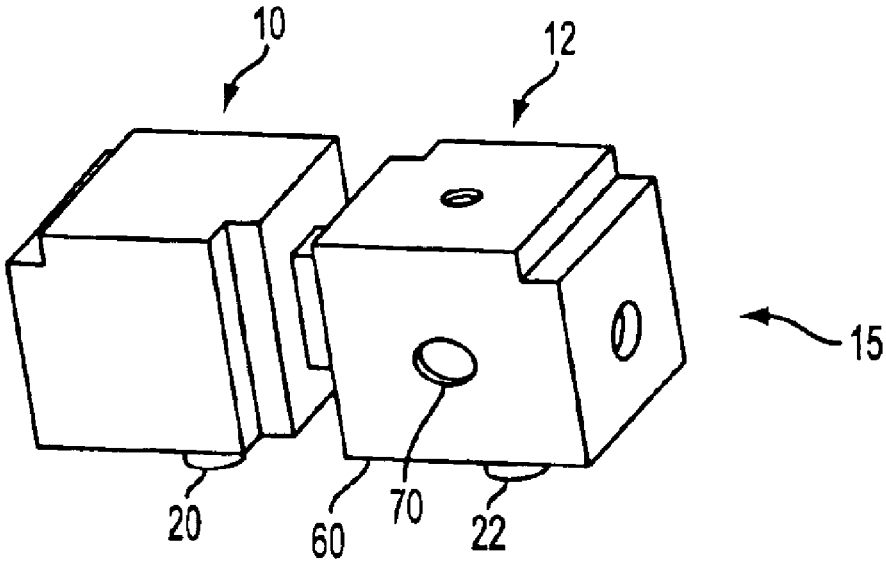
FIG. 8*b* illustrates tuning resonant frequencies of the three modes in the block using indentations or circles in three orthogonal sides.
Figure 9:
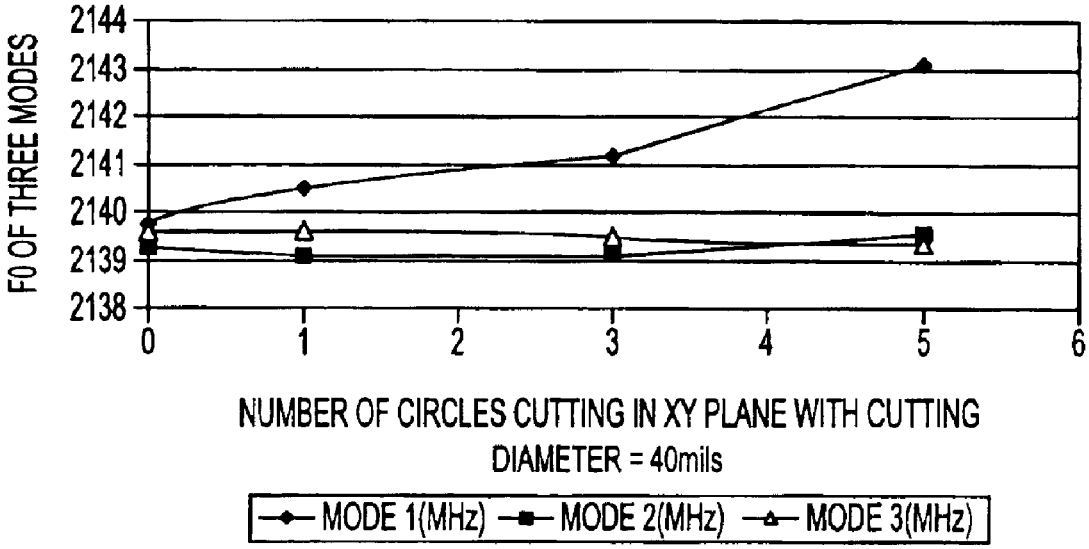
FIG. 9 is a graph showing the change in frequency for Mode 1 when successive circles are cut away from the X-Y face of the mono-block.

Another method of tuning frequency is to cut a slot 50, 52 within a face 60 of the resonator 10 (see FIG. 4). By simply cutting the proper slots 50, 52 in the conductive layer, one can tune any particular mode to a lower frequency. The longer the slot 50, 52, the greater the amount that the frequency is lowered. FIG. 9 shows the change in frequency for Mode 1 when successive circles 70 (diameter=0.040 inches) close to the face center are cut away from the X-Y face (or plane) 60 of the mono-block 10. In a similar fashion, one can tune Mode 2 to a higher frequency by removing small circles 70 of metal from the X-Z face (or plane) 60, and one can tune Mode 3 to higher frequency by the same process applied to the Y-Z face (or plane) 60. Note that, in FIG. 9, Modes 2 and 3 are relatively unchanged while the frequency of Mode 1 increases. The depth and diameter of the hole affects the frequency. Once again, only the frequency of one of the coupled modes is affected using this method. The resonant frequency of the other two modes is unaffected. The metal can be removed by a number of means including grinding, laser cutting, chemically etching. electric discharge machining or other means. FIG. 8(*b*) shows the use of three circles (or indentations) 70 on three orthogonal faces 60 of one of two triple-mode mono-blocks 10, 12 connected together.

They are used to adjust the resonant frequencies of the three modes in the one block 12. Tuning for only one block is shown in this figure. Tuning for the second block (the one on the left) 10 would be similar.

Figure 10A:
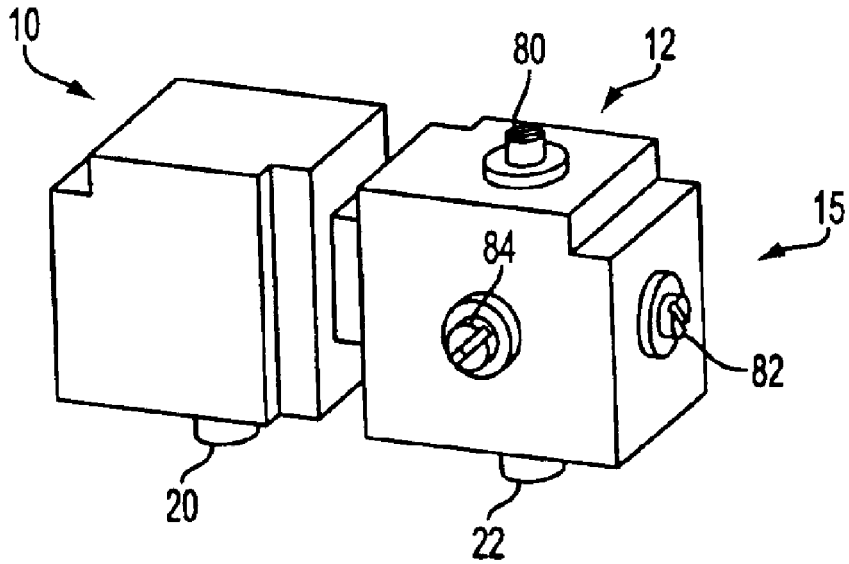
FIGS. 10*a* and *b* illustrate tuning resonant frequencies of the three modes in the block using metallic or dielectric tuners attached to three orthogonal sides (FIG. 10*a*), or metallic or dielectric tuners protruding into the mono-block (FIG. 10*b*).
Figure 10B:
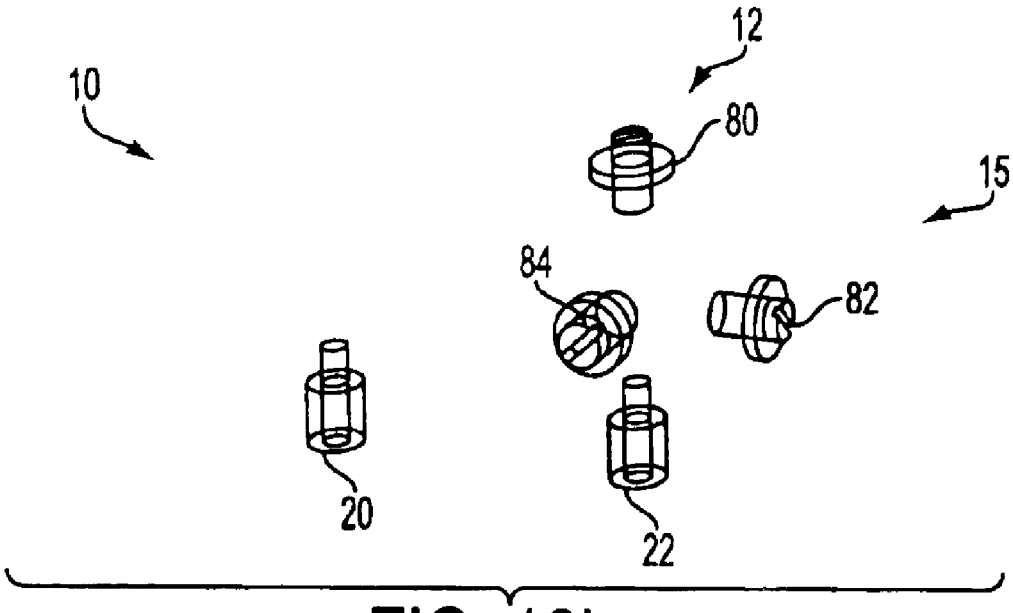
Figure 11D:
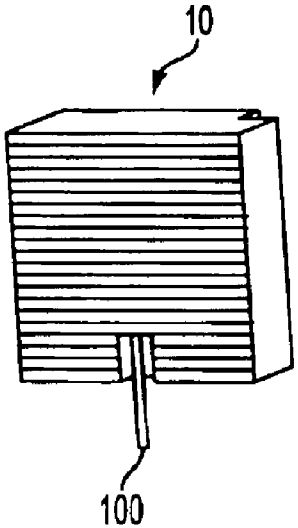
FIGS. 11*a, b, c* and *d* illustrate a method for the input/output coupling for the triple-mode mono-block filter.
Figure 11C:
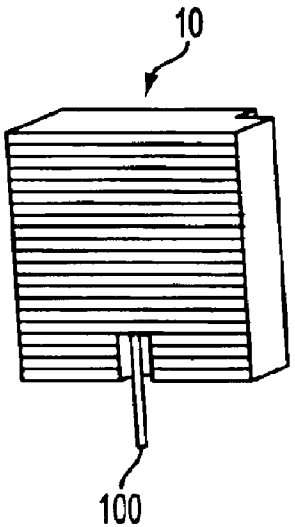
Figure 11B:
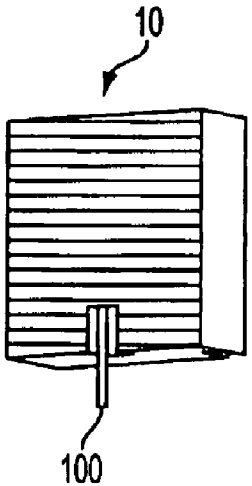
Figure 11A:
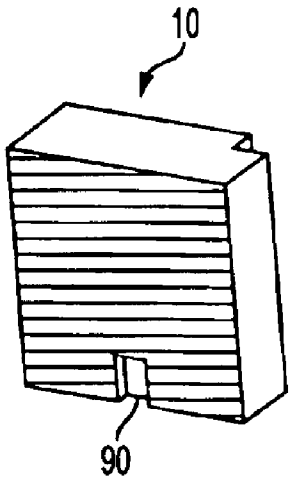

The fourth tuning method disclosed here is the use of discrete tuning elements or cylinders 80, 82, 84. FIGS. 10(*a*) and 10(*b*) show the 3 elements 80, 82, 84 distributed among three orthogonal faces 60 of the mono-block 10, to affect the necessary change of the resonant frequencies. FIG. 10(*a*) shows an alternate method for tuning whereby metallic or dielectric tuners are attached to three orthogonal sides and the metallic or dielectric elements protrude into the mono-block 10, as shown in FIG. 10(*b*). Tuning for only one block is shown in this figure. Tuning for the second block (the block on the left) would be similar. The tuning elements 80, 82, 84 can be metallic elements which are available from commercial sources. (See, for example, the metallic tuning elements available from Johanson Manufacturing, http://www.iohansonmfg.com/mte.htm#.) One could also use dielectric tuning elements, also available from commercial sources (again, see Johanson Manufacturing, for example).

The description above is focused mainly on the use of a triple-mode mono-block 10 in a filter. It should be understood that this disclosure also covers the use of the triple-mode mono-block filter as part of a multiplexer, where two or more filters are connected to a common port. One or more of the multiple filters could be formed from the triple-mode mono-blocks.

Input/Output

Input/Output: A proper method for transmitting a microwave signal into (input) and out of (output) the triple-mode mono-block filter is by the use of probes. The input probe excites an RF wave comprising of a plurality of modes. The corner cuts then couple the different modes. K. Sano and M. Miyashita, "Application of the Planar I/O Terminal to Dual-Mode Dielectric-Waveguide Filter," IEEE Trans. Microwave Theory Tech., pp. 249 1–2495, December 2000, hereby incorporated by reference, discloses a dual-mode mono-block having an input/output terminal which functions as a patch antenna to radiate power into and out of the mono-block.

The method disclosed in the present invention is to form an indentation 90 in the mono-block (in particular, a cylindrical hole was used here), plate the interior of that hole 90 with a conductor (typically, but not necessarily, silver), and then connect the metallic surface to a circuit external to the filter/mono-block, as shown in FIG. 11. The form of the connection from the metallic plating to the external circuit can take one of several forms, as shown in FIG. 11 in which the interior or inner diameter of a hole or indentation is plated with metal (FIG. 11(*a*)). Next, an electrical connection 100 is fixed from the metal in the hole/indentation 90 to an external circuit, thus forming a reproducible method for transmitting a signal into or out of the triple-mode mono-block 10. In FIG. 11(*b*) a wire is soldered to the plating to form the electrical connection 100, in FIG. 11(*c*) a press-in connector 100 is used and in FIG. 11(*d*) the indentation is filled with metal including the wire 100.

Since the probe 100 is integrated into the mono-block 10, play between the probe and the block is reduced. This is an improvement over the prior art where an external probe 100 was inserted into a hole 90 in the block 100. Power handling problems occurred due to gaps between the probe 100 and the hole 90.

Integrated Filter Assembly Comprising a Preselect or Mask Filter, a Triple-Mode Mono-Block Resonator and a Low-Pass Filter Several features/techniques have been developed to make the triple-mode mono-block filter a practical device. These features and techniques are described below and form the claims for this disclosure.

Figure 12A:
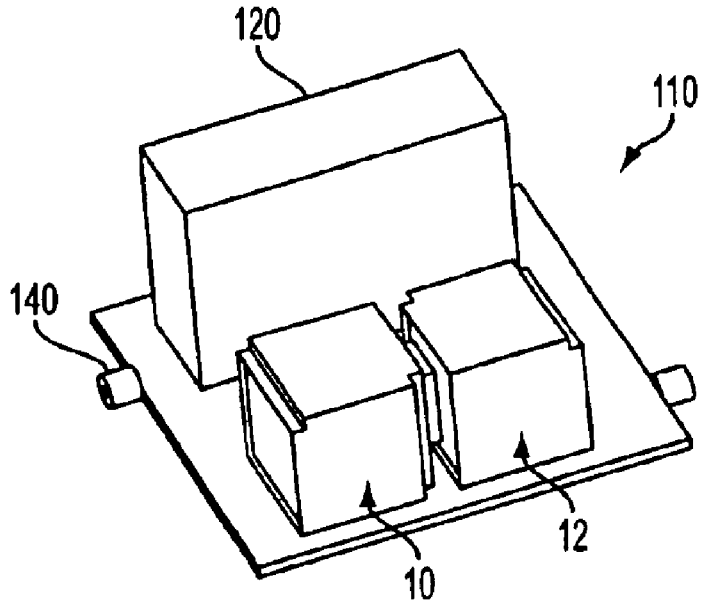
FIGS. 12*a* and 12*b* illustrates an assembly configuration in which the low pass filter is fabricated on the same circuit board that supports the mono-block filter and mask filter.
Figure 12B:
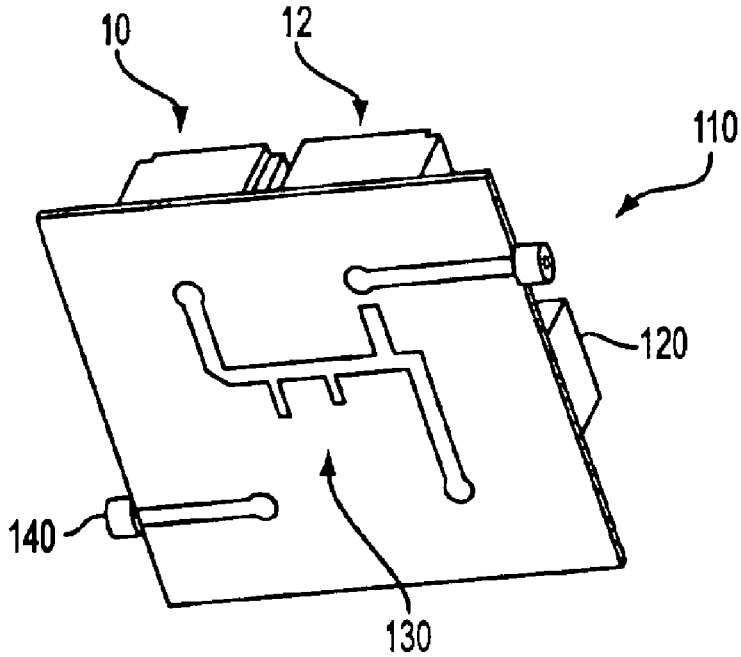

Filter Assembly: The novel and unobvious filter assembly 110 consisting of three parts, the mono-block resonator 10, premask (or mask) 120 and low-pass filters 130, can take one of several embodiments. In one embodiment, the three filter elements are combined as shown in FIG. 12*a*, with connections provided by coaxial connectors 140 to the common circuit board. In this embodiment, the LPF 130 is etched right on the common circuit board as shown in FIG. 12*b*. The low pass filter 130 is fabricated in microstrip on the same circuit board that supports the mono-block filter 10, 12 and the mask 120 filter.

The low pass filter 130 shown in FIGS. 12*a* and 12*b* consist of three open-ended stubs and their connecting sections. The low pass filter 130 design may change as required by different specifications.

Figure 13:
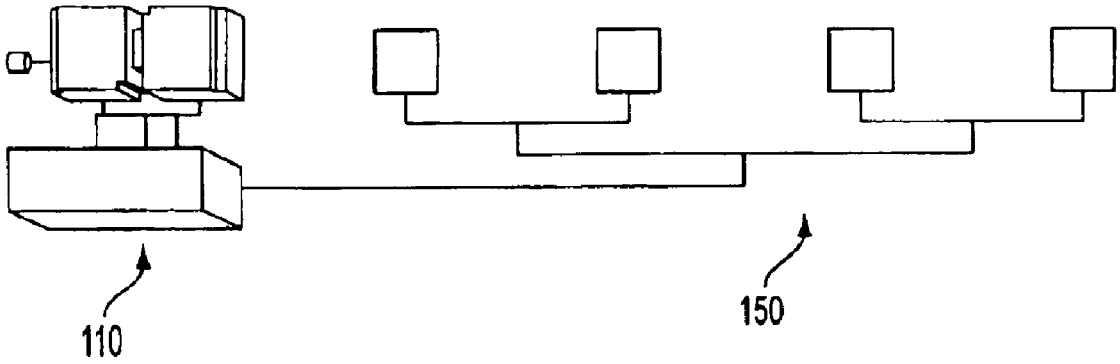
FIG. 13 illustrates an assembly in which the mono-block filter and combline filter are mounted to the same board that supports a 4-element antenna array.

In a second embodiment, the circuit board supporting the filter assembly 110 is an integral part of the circuit board that is formed by other parts of the transmit and/or receive system, such as the antenna, amplifier, or analog to digital converter. As an example, FIG. 13 shows the filter assembly 110 on the same board as a 4-element microstrip-patch antenna array 150. The mono-block filter 10, 12 and combline (or premask) filter 120 are mounted to the same board that supports a 4-element antenna array 150. The mono-block 10 and mask filters 120 are on one side of the circuit board. The low pass filter 130 and the antenna 150 are on the opposite side. A housing could be included, as needed.

Figure 14A:
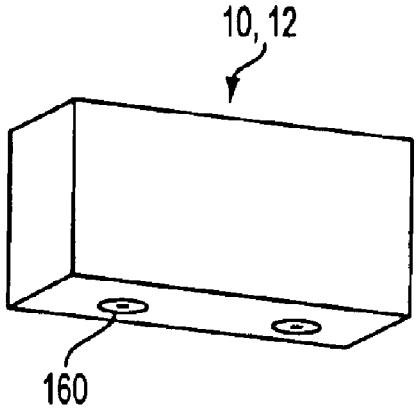
FIGS. 14*a, b* and *c* illustrate a mono-block filter packaged in a box (FIG. 14*a*), with internal features highlighted (FIG. 14*b*).
Figure 14B:
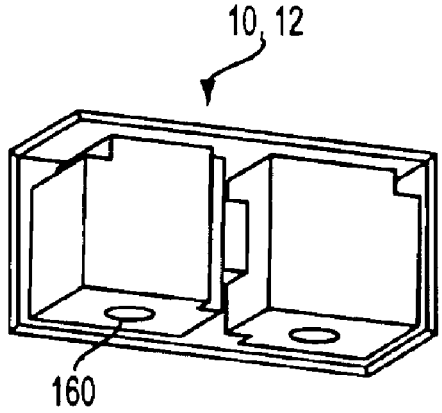
FIG. 14*c* shows a similar package for a duplexer.
Figure 14C:
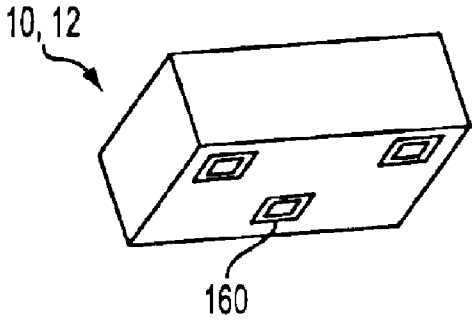

In a third embodiment, the filter assembly 110 is contained in a box and connectors are provided either as coaxial connectors or as pads that can be soldered to another circuit board in a standard soldering operation. FIG. 14 shows two examples of packages with pads 160. The filter package can include cooling fins if required. A package of the type shown in FIG. 14 may contain only the mono-block 10, 12, as shown, or it may contain a filter assembly 110 of the type shown in FIG. 13. FIG. 14(*a*) shows the mono-block filter 10,12 packaged in a box with the internal features highlighted in FIG. 14(*b*). The pads 160 on the bottom of the box in FIG. 14(*a*) would be soldered to a circuit board. FIG. 14(*c*) shows a similar package for a duplexer consisting of two filters with one common port and, therefore, three connecting pads 160. A package of the type shown here may contain only the mono-block 10, 12 or it may contain a filter assembly 110.

Preselect or Mask Filter: Common to any resonant device such as a filter is the problem of unwanted spurious modes, or unwanted resonances. This problem is especially pronounced in multi-mode resonators like the triple-mode mono-block 10, 12. For a triple-mode mono-block 10, 12 designed for a pass band centered at 1.95 GHz, the first resonance will occur near 2.4 GHz. In order to alleviate this problem, we disclose the use of a relatively wide-bandwidth mask filter 120, packaged with the mono-block filter 10, 12.

Figure 15:
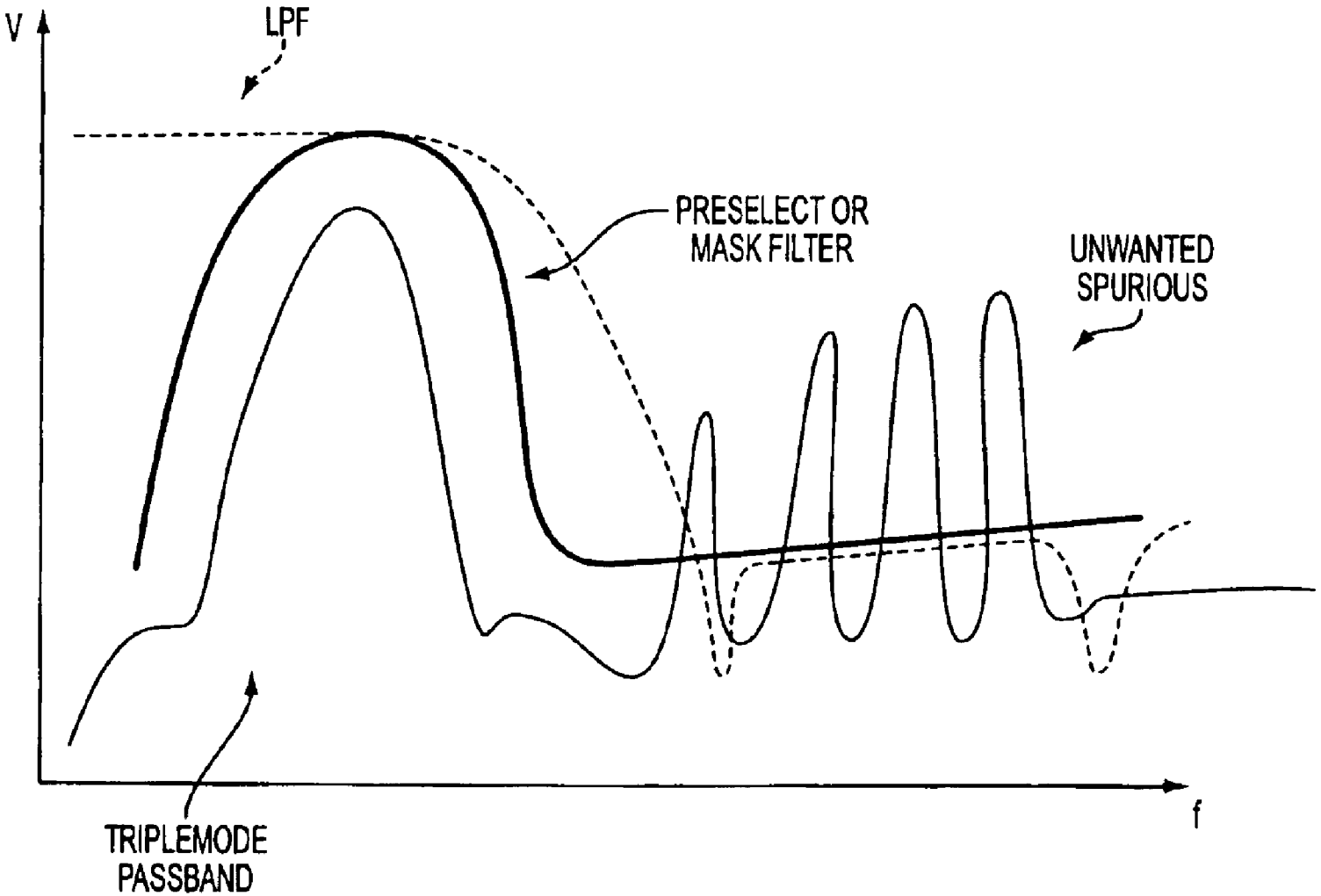
FIG. 15 illustrates the low-pass filter (LPF), the preselect or mask filter and the triple-mode mono-block passband response.

The premask filter 120 acts as a wide-bandwidth bandpass filter which straddles the triple-mode mono-block 10, 12 passband response. Its passband is wider than the triple-mode mono-block 10, 12 resonator's passband. Therefore, it won't affect signals falling within the passband of the triple-mode mono-block resonator 10, 12. However, it will provide additional rejection in the stopband. Therefore, it will reject the first few spurious modes following the triple-mode mono-block resonator's 10, 12 passband. See FIG. 15.

In example 1, a filter assembly was designed for 3G application. In a preferred embodiment, it is used in a Wideband Code Division Multiple Access (WCDMA) base station. It had an output frequency of about f0=2.00 GHz and rejection specification out to 12.00 GHz. The receive bandwidth is 1920 to 1980 MHz. The transmit bandwidth is 2110 to 2170 MHz. In the stopband for transmit mode, the attenuation needs to be 90 dB from 2110 to 2170 MHz, 55 dB from 2170 to 5 GHz and 30 dB from 5 GHz to 12.00 GHz. A preselect or mask filter 120 was selected with a passband from 1800 MHz to 2050 MHz and a 60 dB notch at 2110 MHz. Between 2110 MHz and 5 GHz it provides 30 dB of attenuation.

Figure 16A:
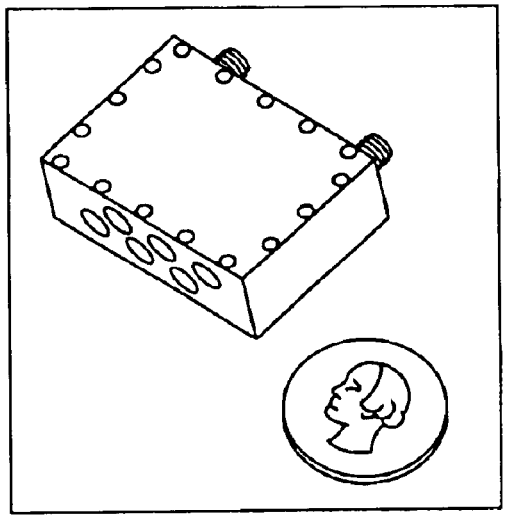
FIGS. 16*a* and *b* illustrate the mask filter.
Figure 16B:
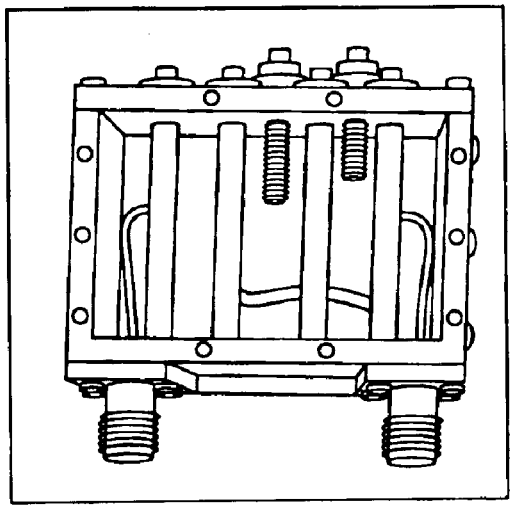

In example 1, the mask filter 120 has a 250 MHz bandwidth and is based on a 4-pole combline design with one cross coupling that aids in achieving the desired out-of-band rejection. The mask filter 120 is shown in FIG. 16. FIG. 16(*a*) shows a 4-pole combline filter package and FIG. 16(*b*) shows the internal design of the 4 poles and the cross coupling. The SMA connectors shown in FIG. 16(*b*) are replaced by direct connections to the circuit board for the total filter package.

Low Pass Filter: It is common for a cellular base station filter specification to have some level of signal rejection required at frequencies that are several times greater than the pass band. For example, a filter with a pass band at 1900 MHz may have a rejection specification at 12,000 MHz. For standard combline filters, a coaxial low-pass filter provides rejection at frequencies significantly above the pass band. For the filter package disclosed here, the low pass filter 130 is fabricated in microstrip or stripline, and is integrated into (or etched onto) the circuit board that already supports and is connected to the mono-block filter 10, 12 and the mask filter 120. The exact design of the low pass filter 130 would depend on the specific electrical requirements to be met. One possible configuration is shown in FIGS. 12*a* and 12*b*.

Delay Filter

In another non-limiting, exemplary embodiment, a delay filter is provided that is designed for its flat, group delay characteristics. For example, but not by way of limitation, in this embodiment, the delay filter is not designed for any particular frequency rejection.

To achieve a flat group delay, it is necessary to have a prescribed cross-coupling scheme. For example, but not by way of limitation, in a six-pole filter, at least modes 1–2, 2–3, 3–4, 4–5 and 5–6 would be coupled. Further, prescribed cross-couplings are used to help meet certain frequency rejection specifications. In the case of the present embodiment, the cross couplings used to flatten the delay are 1–6 and 2–5 for a six-pole filter.

Figure 17A:
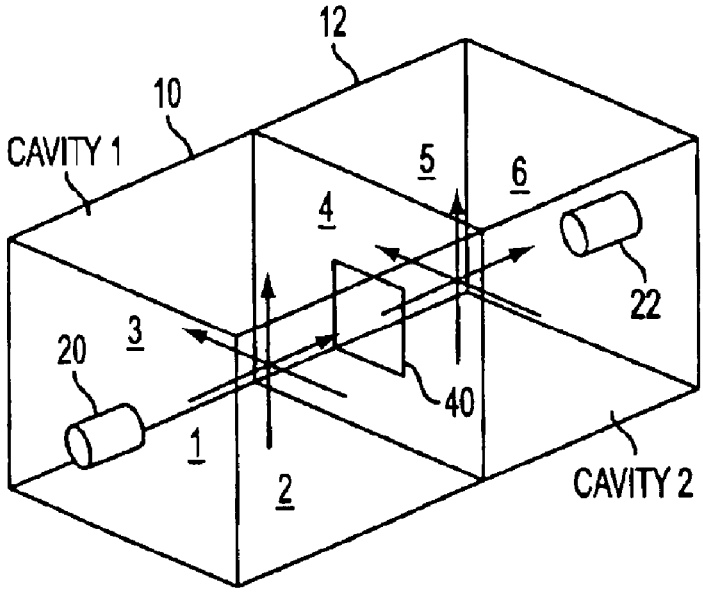
FIGS. 17(*a*) and (*b*) illustrate a triple-mode mono-block delay filter according to an illustrative embodiment of the present invention.
Figure 17B:
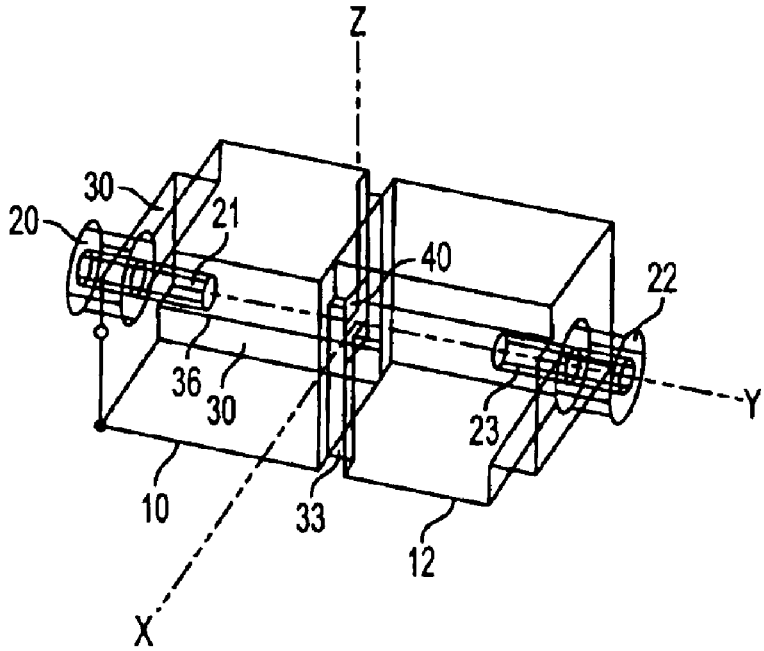

To implement the foregoing embodiment, a geometry as illustrated in FIGS. 17(*a*) and (*b*) is provided. In contrast to the embodiment of the present invention illustrated in FIG. 2, the input/output probes 20, 22 are positioned at the end faces of the assembly, rather than on the same side of the two blocks as illustrated in FIG. 2. As a result, positive cross-couplings between modes 1–6 and 2–5 are possible, whereas in the embodiment illustrated in FIG. 2, the 1–6 cross coupling is negative, and there is no 2–5 cross coupling. As a result, a flat group delay is possible in the preferred embodiment of the present invention.

As described in greater detail above, the triple-mode mono-block delay filter includes two triple-mode mono-block cavity resonators 10, 12. Each triple-mode mono-block resonator has three resonators in one block. The three modes that are being used are the TE101, TE011 and TM110 modes, which are mutually orthogonal. The electric field orientations of the six modes 1 . . . 6 are arranged in the directions shown in FIG. 17(*a*), so that equalized delay response of the filter can be achieved. For example, but not by way of limitation, the delay filter requires all positive couplings between resonator 1 and 2, resonator 2 and 3, resonator 3 and 4, resonator 4 and 5, resonator 5 and 6, resonator 1 and 6, resonator 2 and 5.

An input/output probe e.g., 20 is connected to each metal plated dielectric block e.g., 10 to transmit the microwave signals. The coupling between resonant modes within each cavity is accomplished by the above-described corner cuts 30, 33, 36. Corner cuts are used to couple a mode oriented in one direction to a mode oriented in a second mutually orthogonal direction. There are two main corner cuts 30, 33 to couple the three resonators in each cavity, one oriented along the x-axis and one oriented along the y-axis. An aperture 40 between the two blocks 10, 12 is used to couple all six resonant modes 1 . . . 6 together between the cavities. The aperture 40 generates two inductive couplings by magnetic fields between two modes, and one capacitive coupling by electric fields. In addition, a third corner cut 36 along the z-axis can be used to cancel the undesired coupling among resonators. A wireframe view of the triple-mode mono-block delay filter is shown in FIG. 17(*b*) with the corner cuts 30, 33, 36 and the coupling aperture 40.

Figure 18A:
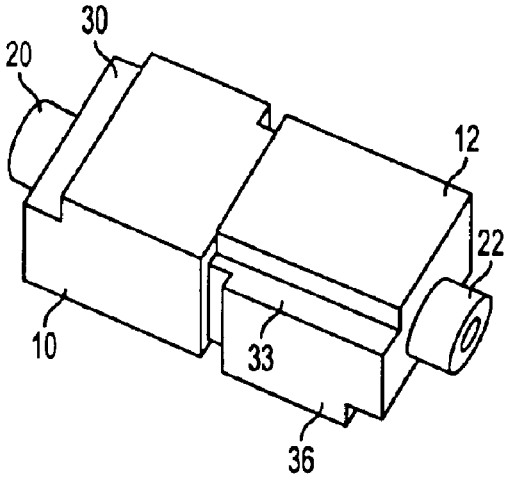
FIGS. 18(*a*) and (*b*) illustrate solid views of the triple-mode mono-block delay filter according to the present invention.
Figure 18B:
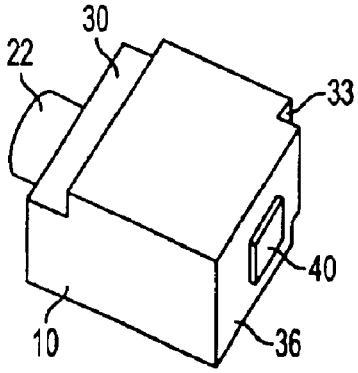

FIGS. 18(*a*) and (*b*) show the solid views of the two mono-blocks 10, 12 coupled to form a 6-pole delay filter. Corner cuts 30, 33, 36 are used to couple a mode oriented in one direction to a mode oriented in a second mutually orthogonal direction within a mono-block cavity. Each coupling represents one pole in the filter's response. Therefore, one triple-mode mono-block discussed above represents the equivalent of three poles or three electrical resonators. FIG. 17(*b*) and FIG. 18 show the third corner cut 36 that provides a cross coupling between modes 1 and 3, modes 4 and 6 in the filter. By the appropriate choice of the particular block edge for this corner cut, either positive or negative cross coupling is possible. The third corner cut 36 can be used to improve the delay response of the filter, or cancel the unwanted parasite effects within the triple-mode mono-block filter.

Figure 19:
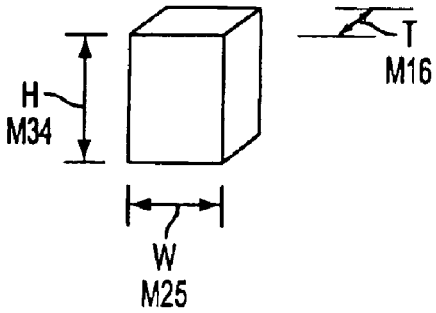
FIG. 19 illustrates a function of an aperture in the delay filter according to the present invention.

The aperture 40 performs the function of generating three couplings among all six resonant modes for delay filter, instead of two couplings for the regular bandpass filter. The aperture 40 generates two inductive couplings by magnetic fields between modes 3 and 4, modes 2 and 5; and one positive capacitive coupling by electric fields between modes 1 and 6, as shown in FIG. 19. Adjusting aperture height H will change the coupling M34 most, and adjusting aperture width W will change the coupling M25 most. Similarly, changing the aperture's thickness T can adjust the coupling M16 which is coupled by electric fields.

Figure 20:
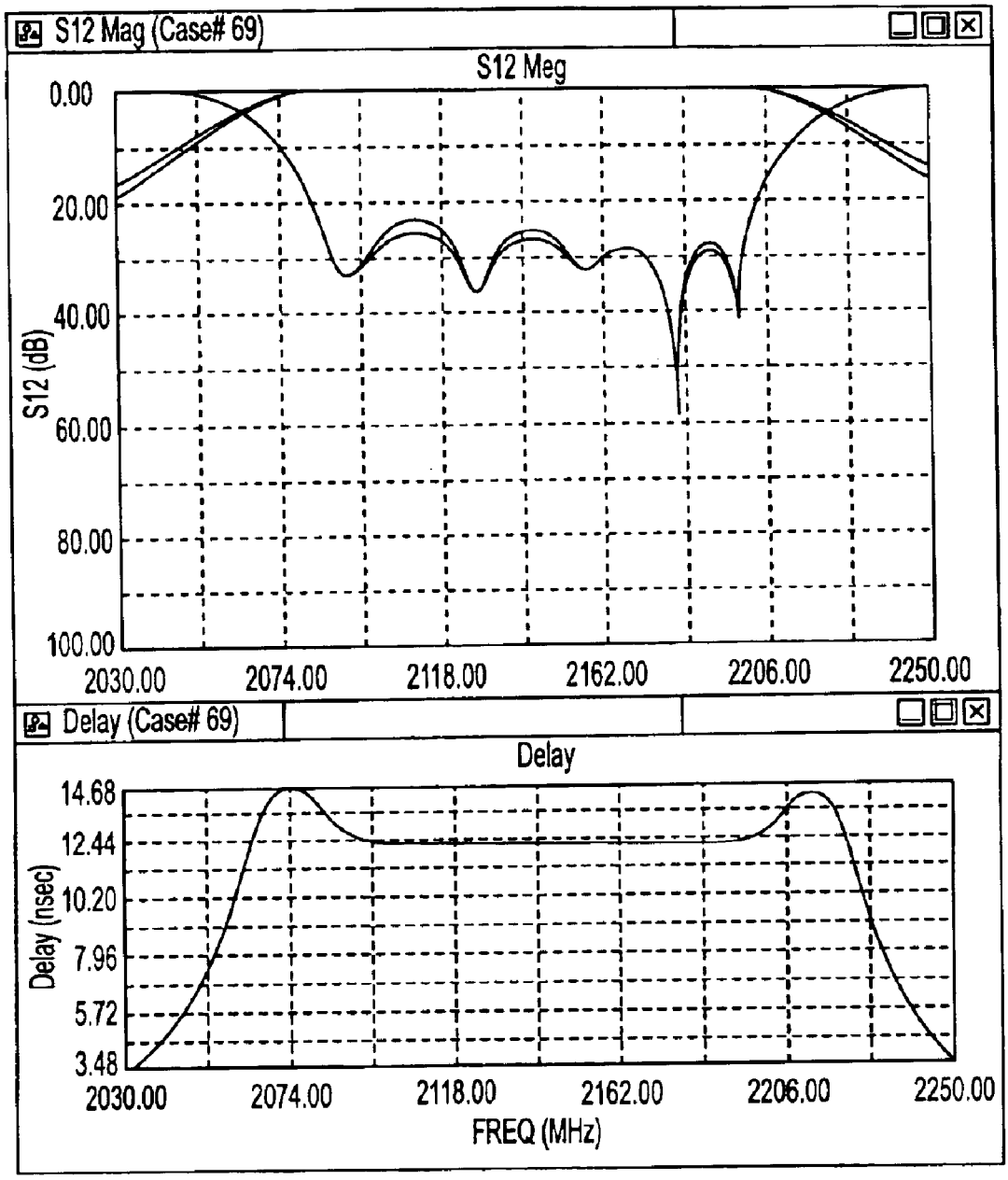
FIG. 20 illustrates simulated frequency responses of the triple-mode mono-block delay filter according to this preferred embodiment of the present invention.

FIG. 20 shows the simulated frequency responses of the triple-mode mono-block delay filter at center frequency of 2140 MHz by HFSS 3D electromagnetic simulator. The filter has over 20 dB return loss and very flat group delay over wide frequency range.

Hybrid Filter

In another non-limiting, exemplary embodiment, a hybrid 7-, 8- or N-pole filter is provided. By coupling a metallic resonator block having any number of resonators to the ceramic triple-mode mono-blocks 10, 12, a hybrid 7-, 8- or N-pole filter can be obtained.

Figure 21A:
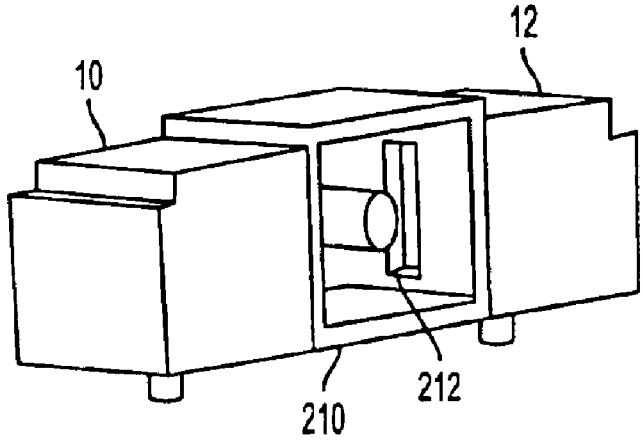
FIG. 21(*a*) is a solid view of a hybrid filter assembly according to an illustrative embodiment of the present invention.
Figure 21B:
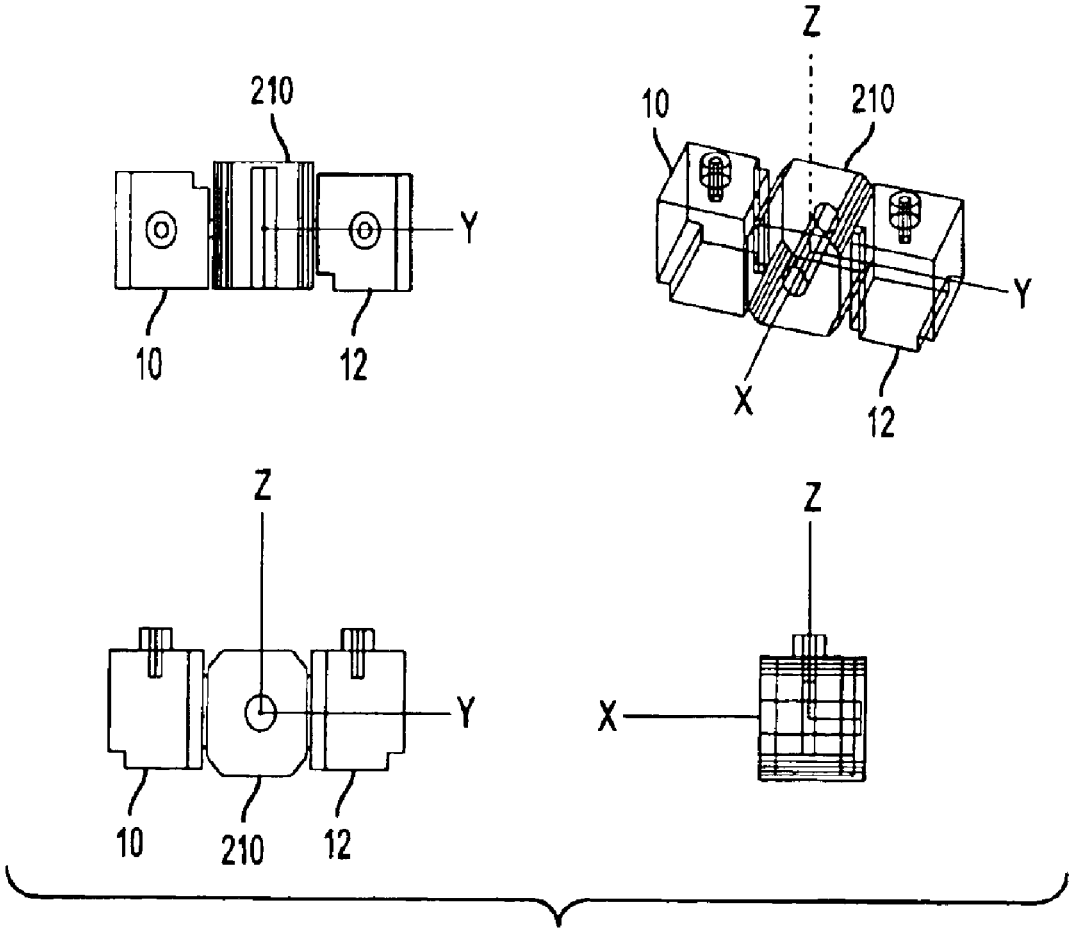

FIGS. 21(*a*) and 21(*b*) illustrate a 7-pole hybrid filter having 6 poles (resonators) contributed by the two ceramic triple-mode mono-block cavity resonators 10, 12 and one pole contributed by a metallic coaxial resonator block 210 having one resonator. In this example, the metallic coaxial resonator block 210 is positioned between the two block resonators 10, 12. FIG. 21(*a*) shows a solid model of the 7-pole hybrid filter, with the coaxial input/output lines on top of the two ceramic mono-blocks 10, 12. FIG. 21(*b*) shows multiple wire-frame views of the hybrid filter assembly shown in FIG. 21(*a*). A cover (not shown) is placed on top of the metallic coaxial resonator block 210.

Electromagnetic coupling between the ceramic triple-mode mono-blocks 10, 12 and the metallic coaxial resonator block 210 is accomplished by an open slot or aperture 212 in the metal housing of the metallic coaxial resonator block 210 and the metal plating on the side of the ceramic mono-blocks 10, 12. The dimensions of the slot or aperture 212 are determined by the desired electrical characteristics of the filter.

For example, a wider bandwidth for the pass band will require a larger aperture because of the greater coupling required. The coupling as shown is mainly a magnetic coupling. Although FIGS. 21(*a*) and 21(*b*) show coupling by means of a slot or aperture 212, a capacitive probe could also be used for electrical coupling or an inductive loop to assist in achieving the desired coupling. In addition, tuning screws can be utilized in ceramic mono-blocks 10,12 and metallic coaxial resonator block 210 in order to achieve the desired frequency characteristics.

Figure 22A:
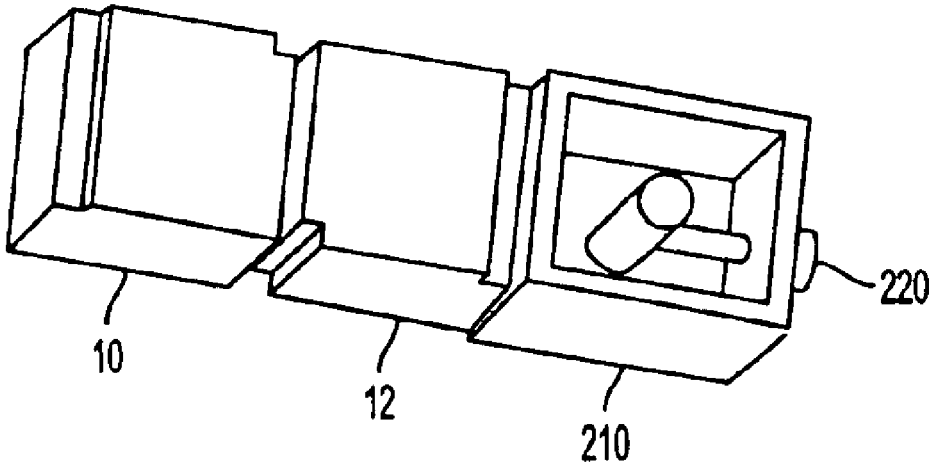
FIG. 22(*a*) is a top view of a hybrid filter assembly according to another illustrative embodiment of the present invention.
Figure 22B:
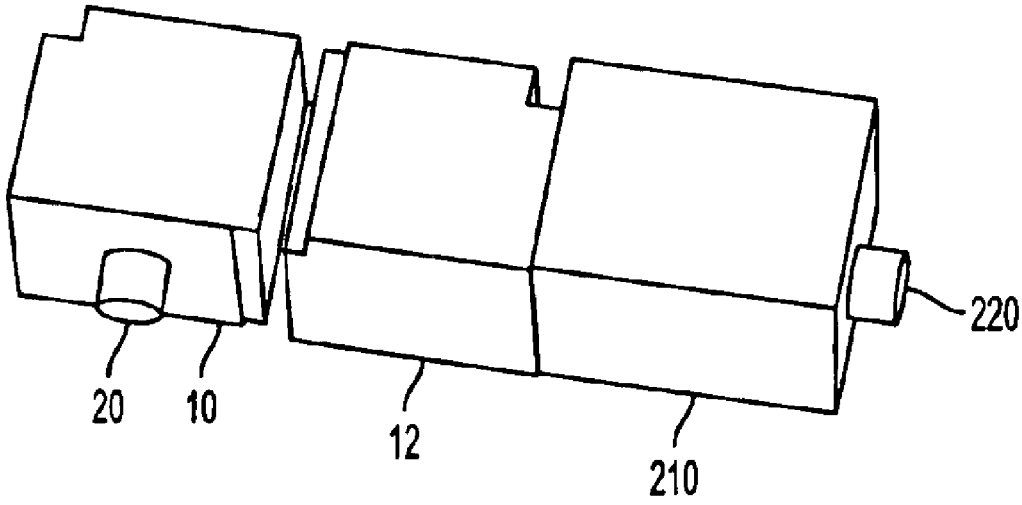

FIGS. 21(*a*) and 21(*b*) show the coaxial metallic resonator block 210 disposed between the two ceramic triple-mode mono-blocks 10, 12. Alternatively, FIGS. 22(*a*) and 22(*b*) show a top view and a bottom view of a hybrid filter assembly, wherein the metallic coaxial resonator block 210 disposed at one end of the filter assembly, with the two triple-mode mono-blocks 10, 12 disposed next to each other. An input/output transmission line 220 having a direct-tap to the coaxial resonator is provided at one end of the filter assembly and input/output probe 20 is provided in the ceramic triple mono-block 10. As an alternative to line 220, a coupling loop could be used as an input/output structure.

Figure 23:
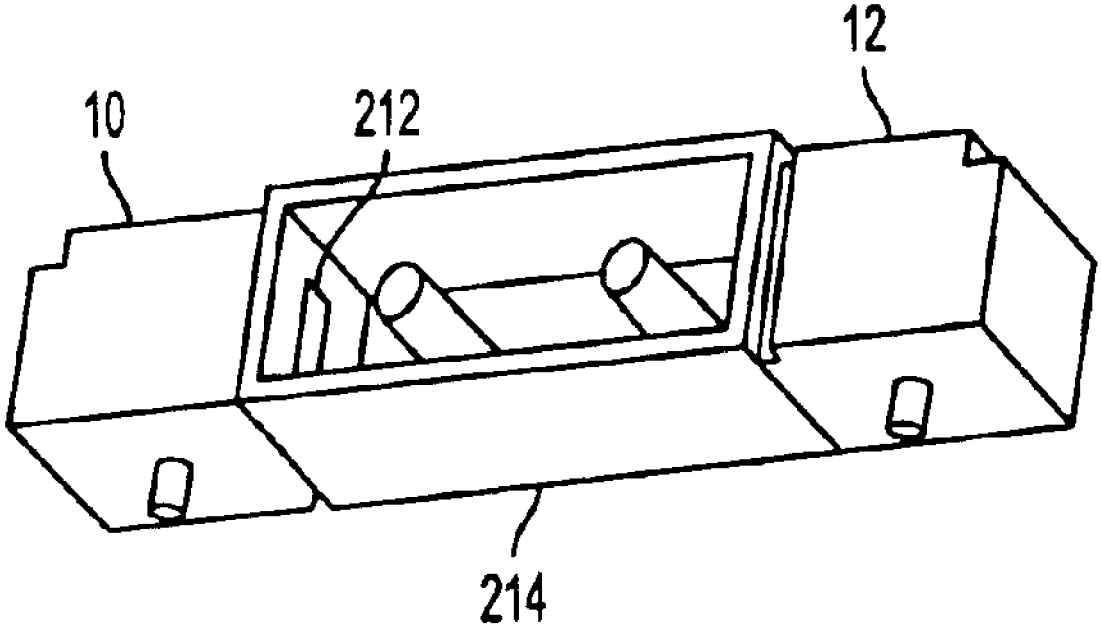
FIG. 23 is a solid view of a hybrid filter assembly according to another illustrative embodiment of the present invention.

FIG. 23 shows another embodiment of the hybrid filter according to the present invention. Here, a coaxial metallic resonator block 214 having two resonators is disposed between the two ceramic triple-mode mono-blocks 10, 12, thereby providing an 8-pole filter assembly. The 8-pole hybrid filter has 6 poles (resonators) contributed by the two ceramic triple-mode mono-block cavity resonators 10, 12 and one pole contributed by each of the resonators in the metallic coaxial resonator block 214.

The ceramic block-to-metallic resonator coupling in the 8-pole filter assembly is the same as that described above with reference to FIGS. 21(*a*) and 21(*b*). The magnetic coupling is controlled by the dimensions of the aperture 212 between the ceramic mono-blocks 10, 12 and the coaxial metallic resonator block 214.

Figure 24A:
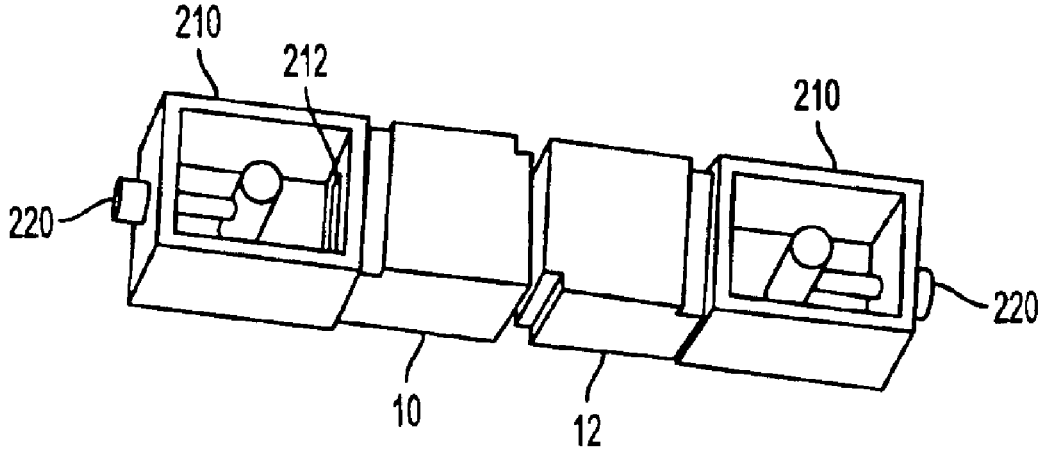
FIG. 24(*a*) is a top view of a hybrid filter assembly according to another illustrative embodiment of the present invention.
Figure 24B:
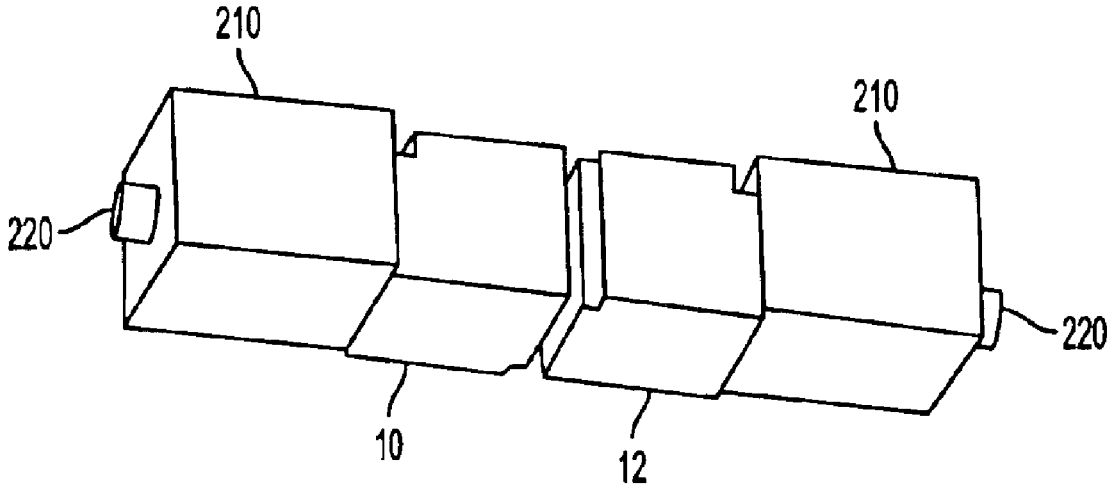

FIGS. 24(*a*) and 24(*b*) show a top view and a bottom view of an 8-pole hybrid filter assembly according to another illustrative embodiment of the present invention. In this embodiment, resonator blocks 210 are disposed at both ends of the filter assembly such that the two triple-mode mono-blocks 10, 12 are disposed next to each other. Input/output transmission lines 220 are provided for coupling a signal into and out of the filter assembly. As an alternative to lines 220, coupling loops could be used as the input/output structure.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments without the use of inventive faculty.

For example, some or all of the features of the different embodiments discussed above may be combined into a single embodiment. Conversely, some of the features of a single embodiment discussed above may be deleted from the embodiment. Therefore, the present invention is not intended to be limited to the embodiments described herein but is to be accorded the widest scope as defined by the limitations of the claims and equivalents.

What is claimed is:

1. A compact resonator filter assembly, comprising:

a first triple-mode mono-block resonator formed of a first dielectric block having a conductive layer formed thereon;

a second triple-mode mono-block resonator formed of a second dielectric block having a conductive layer formed thereon; and at least one metallic coaxial block resonator formed within a metal housing and coupled to at least one of said triple-mode mono-block resonators by an aperature formed in the housing and coupled to an aperture formed in the conductive layer on the at least one of said triple-mode mono-block resonators.

2. The resonator filter assembly according to claim 1, wherein said at least one metallic coaxial block resonator is disposed between said first triple-mode mono-block resonator and said second triple-mode mono-block resonator.

3. The resonator filter assembly according to claim 1, wherein said at least one metallic coaxial block resonator is coupled to only one of said triple-mode mono-block resonators.

4. The resonator filter assembly according to claim 1, wherein said at least one metallic coaxial block resonator is coupled to at least one of said triple-mode mono block resonators via an aperture.

5. The resonator filter assembly according to claim 1, wherein said first triple-mode mono-block resonator and said second triple-mode mono-block resonator each comprises a metal plated dielectric block.

6. The resonator filter assembly according to claim 1, wherein said at least one metallic coaxial block resonator comprises a first metallic coaxial resonator and a second metallic coaxial resonator.

7. The resonator filter assembly according to claim 6, wherein the first metallic coaxial resonator and the second metallic resonator are coupled to one another, and wherein the first and second metallic coaxial resonators are disposed between said first triple-mode mono-block resonator and said second triple-mode mono-block resonator.

8. The resonator filter assembly according to claim 6, wherein the first metallic coaxial resonator is coupled to said first triple-mode mono-block resonator and the second metallic coaxial resonator is coupled to said second triple-mode mono-block resonator, and wherein said first triple-mode mono-block resonator and said second triple-mode mono-block resonator are coupled to one another.

9. A radio frequency communication system comprising:

a base station; and a compact resonator filter assembly coupled to said base station, wherein the resonator filter assembly comprises:

a first triple-mode mono-block resonator formed of a first dielectric block having a conductive layer formed thereon;

a second triple-mode mono-block resonator formed of a second dielectric block having a conductive layer formed thereon; and at least one metalic coaxial block resonator formed within a metal housing and coupled to at least one of said triple-mode mono-block resonators by an aperature formed in the housing and coupled to an aperature formed in the conductive layer on the at least one of said triple-mode mono-block resonators.

10. The radio frequency communication system at according to claim 9, wherein said at least one metallic coaxial block resonator is disposed between said first triple-mode mono-block resonator and said second triple-mode mono-black resonator.

11. The radio frequency communication system according to claim 9, wherein said at least one metallic coaxial block resonator is coupled to at least one of said triple-mode mono block resonators via an aperature.

12. The radio frequency communication system according to claim 9, wherein said at least one metallic coaxial block resonator comprises a first metallic coaxial resonator and a second metallic coaxial resonator.

* * * * *